US005150646A

United States Patent [19]

Lonczak

[11] Patent Number: 5,150,646

[45] Date of Patent: Sep. 29, 1992

[54] STACKING AND BUNDLING FORM FOR NEWSPAPERS TO BE RECYCLED

[76] Inventor: John Lonczak, 14 Park Pl., Newburgh, N.Y. 12550

[21] Appl. No.: 653,620

[22] Filed: Feb. 11, 1991

[51] Int. Cl.[5] ..... B65B 13/18

[52] U.S. Cl. ..... 106/34; 211/50; 229/23 R

[58] Field of Search ..... 100/1, 8, 34; 229/23 R, 229/194, 40, 197, 198.2; 206/83.5; 211/50

[56] References Cited

U.S. PATENT DOCUMENTS

| | | | |
|---|---|---|---|
| 704,080 | 7/1902 | McFadden | 229/23 R |
| 1,975,510 | 10/1934 | Hiatt | 217/3 FC |
| 2,072,256 | 1/1935 | Greve | 229/194 |
| 2,744,461 | 5/1956 | Genco | 100/34 |
| 3,400,877 | 10/1968 | Pierce, Jr. | 229/195 |
| 3,508,699 | 4/1970 | Graser | 217/3 FC |
| 3,903,789 | 9/1975 | Hurley | 100/34 |
| 4,150,612 | 4/1979 | Kessler | 100/34 |
| 4,993,318 | 2/1991 | Bollinger | 100/34 |
| 5,005,709 | 4/1991 | Stokes | 100/34 |

FOREIGN PATENT DOCUMENTS

| | | | |
|---|---|---|---|
| 2400346 | 4/1979 | France | 100/34 |
| 0020171 | 12/1980 | United Kingdom | 229/23 R |

*Primary Examiner*—Philip R. Coe

*Assistant Examiner*—Randall Edward Chin

*Attorney, Agent, or Firm*—Michael Ebert

[57] ABSTRACT

A form adapted to facilitate the neat stacking and bundling of newspapers to be recycled, the form being composed of a pair of complementary sections whose dimensions are such as to accommodate folded standard newspapers and unfolded tabloids. Each section of the form is created from a cardboard blank that is scored, slotted and die cut to define a side wall and major and minor end walls at right angles thereto, each of these walls having a fold-in bottom flap. Projecting from the minor end wall is a locking tongue and cut into the major end wall is a slot to receive a locking tongue. To assemble the form, the sections are placed in opposing relation with their minor and major end walls overlapped, the locking tongue of one section being received in the slot of the other section. In its assembled state, the fold-in flaps of the walls are overlapped at the corners of the form to maintain its rectangular shape. Keyhole slots at the upper edges of the form serve to hold the ends of two cords, one extending longitudinally along the bottom of the form below the papers to be stacked therein and the other extending transversely. After the form is loaded with a pile of stacked papers, the cords are withdrawn from their keyhole slots and tied to bundle the pile which can then be removed from the form.

5 Claims, 1 Drawing Sheet

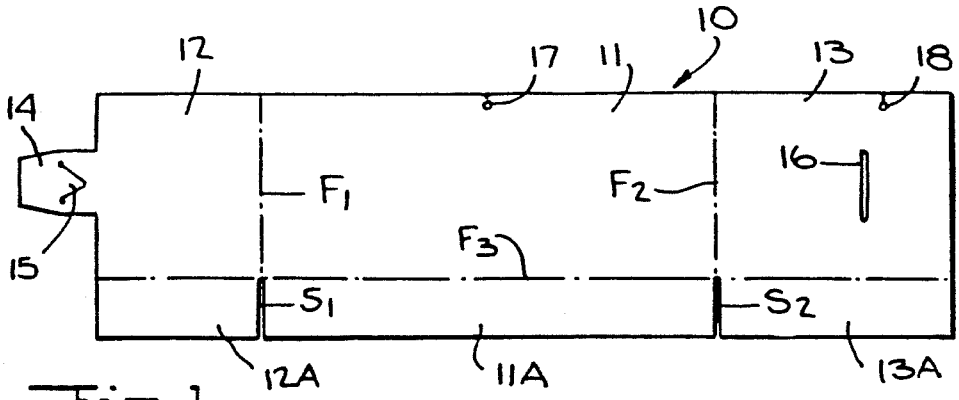
Fig. 1.
Fig. 3.
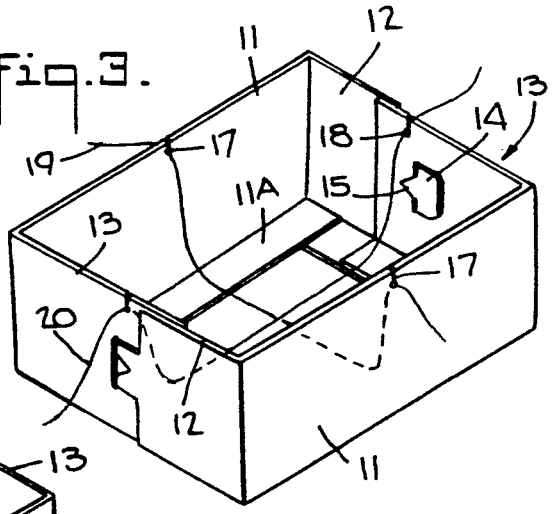
Fig. 2.
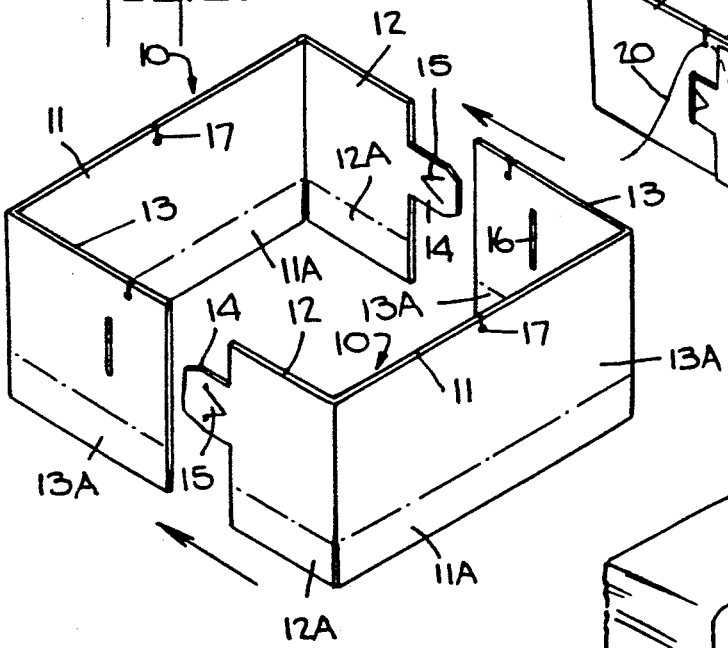
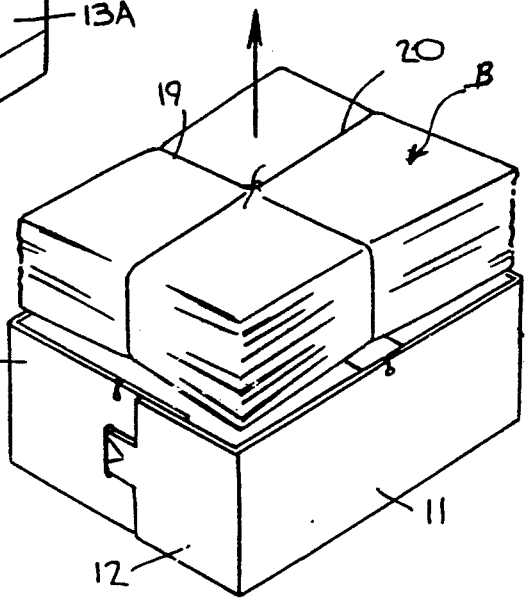
Fig. 4.

STACKING AND BUNDLING FORM FOR NEWSPAPERS TO BE RECYCLED

BACKGROUND OF INVENTION

1. Field of Invention

This invention relates generally to the stacking and bundling of newspapers, and in particular to a rectangular form or matrix adapted to facilitate the stacking and bundling of newspapers which are to be recycled, the form dimensions being such as to accommodate both standard folded newspapers and unfolded tabloids.

2. Status of Prior Art

Environmental protection and the avoidance of waste are now matters of national concern. As a consequence, households in most communities throughout the United States are no longer permitted to treat discarded newspapers as trash to be commingled with garbage. It is now generally mandated that after daily newspapers have served their purpose, they must be stacked and bundled so that they can be picked up at the end of the week or at some other interval by a municipal recycling agency.

Newspapers are printed on long paper sheets which are folded in half to produce four pages. A standard newspaper has a page size of about 14 by 22 inches, whereas the page size of a tabloid is about 14 by 11 inches. However, while a tabloid is delivered to its readers in an unfolded state, the standard newspaper is composed of several sections, each being folded in half. Hence the rectangular dimensions of a standard folded newspaper are about the same as those of an unfolded tabloid. Because of this, tabloids and standard newspapers lend themselves to stacking in the same pile.

After a newspaper has been read by members of a household, it is often generally then in disarray. If, therefore, the newspapers are to be saved for recycling, they must be restored to a somewhat orderly state so that they can be handled in bulk. But if the newspapers to be recycled are stored, say, in a closet or in a basement, it becomes troublesome to produce an orderly pile. As one stacks the papers accumulated in a given day over those laid down from previous days, unless care is exercised, one does not usually succeed in avoiding disarray, for as the pile grows in height, the newspapers are then often askew. This makes it difficult when the time comes to bundle the stack to encircle the stack with a tying cord.

Moreover, a stack of loose newspapers may create a somewhat hazardous condition in the typical household, for loose papers may be blown off the stack by a draft. And if the papers are stacked in a kitchen having a gas-fueled stove, these papers may catch on fire. Quite apart from these considerations is the fact that an exposed pile of newspapers in a kitchen, basement or elsewhere in the household is untidy. Thus while it is the common practice to collect household garbage in plastic trash bags which are concealed in attractive containers having a pivoted lid, there is no equivalent device for newspapers.

SUMMARY OF INVENTION

In view of the foregoing, the main object of this invention is to provide a rectangular form or matrix which facilitates the neat stacking and bundling of newspapers to be recycled.

More specifically, an object of this invention is to provide a stacking and bundling form which has a capacity sufficient to collect into a tidy pile the newspapers accumulated in the course of a week or a longer period.

A significant advantage of the invention is that the form conceals and confines the pile of accumulated papers so that the papers will not be blown away. Nor will the resultant paper pile be conspicuous or offensive to the decor of a household.

Yet another object of the invention is to provide an inexpensive form or matrix of the above type which is constituted by a pair of complementary sections each created from a cardboard or press-board blank that is scored and slotted to define the walls of the form.

Still another object of the invention is to provide a rectangular form adapted to hold lengths of transverse and longitudinal cords below the growing stack of papers piled in the form so that when the form is filled, the cords may then be tied to bundle the stack which can then be removed from the form.

Briefly stated, these objects are attained in a form adapted to facilitate the neat stacking and bundling of newspapers to be recycled, the form being composed of a pair of complementary sections whose dimensions are such as to accommodate folded standard newspapers and unfolded tabloids. Each section of the form is created from a cardboard blank that is scored, slotted and die cut to define a side wall and major and minor end walls at right angles thereto, each of these walls having a fold-in bottom flap. Projecting from the minor end wall is a locking tongue and cut into the major end wall is a slot to receive a locking tongue.

To assemble the form, the sections are placed in opposing relation with their minor and major end walls overlapped, the locking tongue of one section being received in the slot of the other section. In its assembled state, the fold-in flaps of the walls are overlapped at the corners of the form to maintain its rectangular shape. Keyhole slots at the upper edges of the form serve to hold the ends of two cords, one extending longitudinally along the bottom of the form below the papers to be stacked therein and the other extending transversely. After the form is loaded with a pile of stacked papers, the cords are withdrawn from their keyhole slots and tied to bundle the pile which can then be removed from the form.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a plan view of a cardboard blank which when erected creates a complementary section of a rectangular form in accordance with the invention for stacking and bundling newspapers to be recycled;

FIG. 2 illustrates, in perspective, the manner in which a pair of complementary sections are placed in opposed relation and intercoupled to create the form;

FIG. 3 illustrates in perspective the assembled form; and

FIG. 4 illustrates a bundled pile of newspapers being removed from the form.

DESCRIPTION OF INVENTION

Referring now to FIG. 1, there is shown a flat cardboard or press-board blank 10 which when erected creates a complementary section of a rectangular form or matrix in accordance with the invention adapted to facilitate the neat stacking and bundling of newspapers to be recycled.

The newspapers to be stacked in the form are standard folded papers whose rectangular dimensions are about 14 by 11 inches as well as unfolded tabloids having about the same dimensions. The rectangular dimensions of the form, as specified hereinafter, are such as to loosely accommodate these papers as they accumulate, and in doing so to create a tidy stack.

Blank 10 is scored, die cut and slotted to create parallel transverse fold lines $F_1$ and $F_2$ which run from the upper edge of the blank to a point two inches from the lower edge, slots $S_1$ and $S_2$ extending from this point to the lower edge. Extending along the blank and intersecting the junctions of the transverse fold lines $F_1$ and $F_2$ and the related slots $S_1$ and $S_2$ is a longitudinal fold line $F_3$. The fold lines and slots define a broad side wall 11, a minor end wall 12 extending from one end of the side wall, and a major end wall 13 extending from the other end of the side wall.

Side wall 11 is provided with a fold-in bottom flap 11A, while end walls 12 and 13 are respectively provided with fold-in bottom flaps 12A and 13A. The terms major and minor end walls serve to indicate that the major wall is wider than the minor wall.

Projecting from minor end wall 12 is a locking tongue 14 having a triangular locking element 15 die cut therein, this element being bendable. Die cut in major end wall 13 is a slot 16 into which a locking tongue is insertable. A keyhole slot 17 is cut into the upper edge of side wall 11 at its midpoint and a like keyhole slot 18 is cut into the upper edge of a minor end wall 13. In a preferred embodiment of the form, the length of side wall 11 is $14\frac{3}{4}$ inches to accommodate papers having a length of about 14 inches, the length of minor end wall 12 is $5\frac{3}{8}$ inches, and that of major end wall 13 is $7\frac{3}{4}$ inches. These dimensions are such that when a pair of opposed sections is assembled with the major and minor end walls in overlapping relation, as shown in FIG. 3, the width of the resultant form is $11\frac{1}{2}$ inches to accommodate papers having a width of about 11 inches. The height of the form is 6 inches to accommodate a paper pile of about this height.

As shown in FIG. 2, in order to assemble the form, a pair of blanks 10 are set up to provide complementary sections in opposed relation, with the minor and major end walls 12 and 13 at right angles to side walls 11. The minor and major end walls of the opposed sections are overlapped with the tongue 14 of each section being inserted into slot 16 of the other section, after which locking element 15 is bent out to prevent removal of the tongue from the slot, thereby interlocking the sections. And, as shown in FIG. 3, the fold-in flaps 11A, 12A and 13A of the two sections are folded in and intersect each other at the corners of the form to maintain the rectangular shape thereof.

The form is provided with two lengths of cord 19 and 20. The ends of cord 19 are held in the keyhole slots 17 is the side walls 11, this cord extending transversely along the bottom of the form below the paper stack to be loaded into the form. The ends of cord 20 are held in keyhole slots 18 of the major end walls 13, this cord extending longitudinally along the bottom of the form where it intersects cord 19.

The form provided with cords, as shown in FIG. 3, is now in condition for use in a household. In use, the papers accumulated at the end of each day are loaded into the form whose dimensions are such as to accommodate a stack of standard folded newspapers and unfolded tabloids. The six inch height of the form is such as to make it possible to gather into a single pile the typical accumulation of a full week of discarded papers, including a relatively thick Sunday edition. In practice, the blank may be designed to provide a greater or smaller height.

After the form is more or less filled, and this, of course, depends on how many papers accumulate in the course of a week or at the end of whatever other period papers are to be picked up for recycling, cords 19 and 20, as shown in FIG. 4, are tied to create a bundle B which can then be removed from the form.

To prepare the now empty form for reuse, one simply connects fresh cords thereto. Since a local newspaper may wish to encourage householders to collect papers for recycling rather than to treat them as trash, and may wish at the same time to advertise the paper, in practice the cardboard blanks may be provided with a glossy facing ply printed with the name of the local newspaper and carrying recycling information such as the pick-up days. Or promotional material may be printed on the blank.

While there has been shown and described a preferred embodiment of a stacking and bundling form for newspapers to be recycled in accordance with the invention, it will be appreciated that many changes and modifications may be made therein without, however, departing from the essential spirit thereof. Thus instead of cardboard, the blanks may be formed of low-cost synthetic plastic panel material having living hinges to define the fold lines. A form in accordance with the invention may be made to accommodate magazines, Xerox paper copies and other papers to be recycled whose dimensions differ from those of newspapers.

I claim:

1. A rectangular form having an open top adapted to facilitate a neat stacking and bundling of newspapers to be recycled, said form having rectangular dimensions substantially the same as those of a standard folded newspaper and of an unfolded tabloid, said form being composed of a pair of complementary sections, each section comprising:

(a) a broad side wall;

(b) a minor end wall at right angles to one end of the side wall and provided with a projecting locking tongue; and (c) a major end wall at right angles to the other end of the side wall and having a slot therein adjacent its edge to receive the locking tongue of the other section, said major end wall being wider than said minor end wall, said sections being assembled in opposed relation with the major and minor walls partially overlapped, to an extent permitting the tongue of each section to be inserted in the slot of the other section whereby the form has a width determined by the combined dimensions of the partially overlapped major and minor end walls, said side wall and said end walls each being provided with a fold-in, relatively narrow bottom flap, the flaps of the sections overlapping at the corners of the form to maintain its rectangular shape without closing the bottom of the form, the side walls of the sections including upper edges provided with keyhole slots to retain ends of a first cord which extends transversely along the bottom of the form, the major end walls of the sections including upper edges provided with keyhole slots to retain ends of a second cord which extends longitudinally along the bottom of the form, whereby when the form is loaded with a pile of papers which overlie the cords, the ends of the cords may then by removed from said slots and be tied to bundle the pile.

2. A form as set forth in claim 1, in which the sections are fabricated of cardboard.

3. A form as set forth in claim 1, wherein the tongue includes a triangular locking element that after the tongue is inserted in a slot is bent out to lock the tongue in the slot.

4. A form as set forth in claim 1, wherein each section is formed by a single blank which is scored, slotted and die cut to create fold lines which define said side walls and said major and minor end walls, said fold-in bottom flaps, said tongue and said slot.

5. A form as set forth in claim 4, wherein said blank is formed of synthetic plastic panel material.

* * * * *